US007614321B2

(12) United States Patent
Cohen

(10) Patent No.: US 7,614,321 B2
(45) Date of Patent: Nov. 10, 2009

(54) BOTTLE AND CAN OPENER ARRANGEMENT

(76) Inventor: Wayne Cohen, 44 Convent Road, Silom, Bangrak, Bangkok (TH) 10500

( * ) Notice: Subject to any disclaimer, the term of this patent is extended or adjusted under 35 U.S.C. 154(b) by 267 days.

(21) Appl. No.: 11/225,701

(22) Filed: Sep. 12, 2005

(65) Prior Publication Data

US 2007/0056405 A1 Mar. 15, 2007

(51) Int. Cl.
*B67B 7/44* (2006.01)

(52) U.S. Cl. ..... 81/3.09; 81/3.07; 81/3.15; 81/3.36; 81/3.37; 81/3.47; 7/151; 7/170

(58) Field of Classification Search ..... 81/3.07, 81/3.09, 3.15, 3.36, 3.37, 3.47; 7/151, 170
See application file for complete search history.

(56) References Cited

U.S. PATENT DOCUMENTS

| | | | | |
|---|---|---|---|---|
| 1,880,985 | A | 10/1932 | Saunders | |
| 1,972,920 | A | 9/1934 | Deuse | |
| 2,016,513 | A | 10/1935 | Pollock | |
| 4,287,794 | A | 9/1981 | Kubach et al. | |
| 4,560,344 | A | 12/1985 | Kietaibl | |
| 4,617,842 | A * | 10/1986 | Yang | 81/3.09 |
| 4,864,898 | A * | 9/1989 | Tricinella | 81/3.09 |
| 5,169,305 | A | 12/1992 | Kee | |
| 5,483,859 | A | 1/1996 | Singer | |
| D414,090 | S | 9/1999 | Wysopal | |
| D421,372 | S | 3/2000 | Wysopal | |
| 6,056,464 | A | 5/2000 | Cohen | |
| D428,298 | S | 7/2000 | Cohen | |
| D429,942 | S | 8/2000 | Cohen | |
| D437,885 | S | 2/2001 | Cohen | |
| D439,816 | S | 4/2001 | Wysopal | |
| 6,775,869 | B2 * | 8/2004 | Cohen | 7/151 |

FOREIGN PATENT DOCUMENTS

| | | |
|---|---|---|
| FR | 0684613 | 6/1950 |

OTHER PUBLICATIONS

U.S. Appl. No. 60/289,938, filed May 2001, Cohen.
U.S. Appl. No. 09/865,349, filed May 2001, Cohen.

* cited by examiner

*Primary Examiner*—Joseph J Hail, III
*Assistant Examiner*—Shantese McDonald
(74) *Attorney, Agent, or Firm*—LaMorte & Associates

(57) ABSTRACT

A maraca is provided with a handle having a first end and a second end, the second end being coupleable to the maraca. A tool configured to engage a bottle cap may be mounted in the handle. The handle further includes a part configured for engaging an opener or a tab of a can.

5 Claims, 8 Drawing Sheets

BOTTLE AND CAN OPENER ARRANGEMENT

FIELD OF THE INVENTION

The present invention relates general to bottle and can openers. More specifically, the invention relates to a bottle and can opener incorporated into the handle of another item, such as a maraca.

BACKGROUND INFORMATION

One bottle opener which may be attached to a key chain is described in U.S. Pat. No. 4,864,898. This bottle opener includes a body made of a polyamide, such as nylon, which may be fiber filled for added strength and rigidity. A steel edge gripper tool, for use in opening bottle, is joined to the body.

In addition, bottle openers have been introduced which are attached to or incorporated in a percussion instrument, such as a maraca. However, it has been difficult to use any such bottle openers to assist in opening cans, and especially the lift tabs of the aluminum cans. Thus, there is a need to provide an arrangement which includes a percussion instrument and a can opening tool provided therewith.

SUMMARY OF THE INVENTION

Such object of the present invention is addressed using an exemplary maraca which is formed with a handle having a first end and a second end, the second end being coupleable to the maraca. A tool configured to engage a bottle cap may be mounted in the handle. The handle can further include a portion configured for engaging a tab of a can (e.g., an aluminum can).

For example, the maraca may have a handle that also includes a bottle opener and a pressure tab that may function as a can opener is provided. The maraca includes a shell with enclosed pallets and a cylindrical member. The cylindrical member has a first end and a second end and includes an outer surface forming a handle. The first end of the cylindrical member is coupleable to the maraca shell. A groove extends transversely across the handle. The groove includes a first side surface, a second side surface, a bottom surface, and a transverse slot having closed ends and formed into the cylindrical member from the bottom surface. A metal tool is fixed in the slot and is configured to engage a bottle cap. The metal tool, thus, comprises a bottle opener. The second end of the cylindrical member includes an extending portion forming a pressure tab. The pressure tab extends generally parallel with the shell of the maraca when the cylindrical member is coupled to the shell. The pressure tab may function as a can opener.

While multiple embodiments are disclosed, still other embodiments of the invention will become apparent to those skilled in the art from the following detailed description, which shows and describes illustrative embodiments of the invention. As will be realized, the invention is capable of modifications in various obvious aspects, all without departing from the spirit and scope of the invention. Accordingly, the drawings and detailed description are to be regarded as illustrative in nature and not restrictive.

BRIEF DESCRIPTION OF THE DRAWINGS

For a more complete understanding of the present invention and its advantages, reference is now made to the following description, taken in conjunction with the accompanying drawings, in which.

Figure 1:
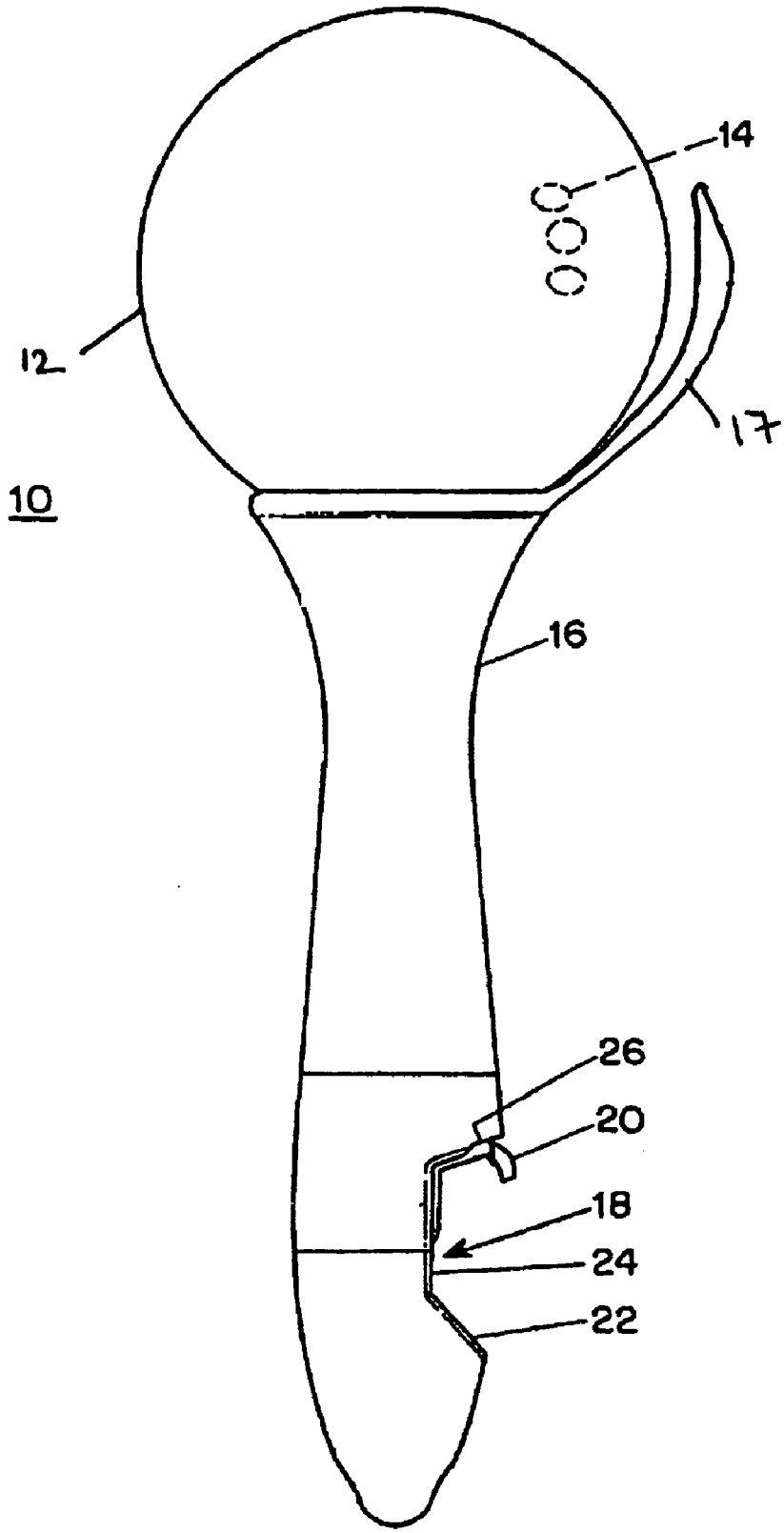
FIG. 1 is a right side view of a maraca in accordance a first exemplary embodiment of the present invention.

Throughout the drawings, the same reference numerals and characters, unless otherwise stated, are used to denote like features, elements, components, or portions of the illustrated embodiments. Moreover, while the present invention will now be described in detail with reference to the Figures, it is done so in connection with the illustrative embodiments.

DETAILED DESCRIPTION

FIG. 1 shows a right side view a maraca 10 in accordance with a first exemplary embodiment of the present invention. The maraca 10 can be formed with a handle 16 having a tool for engaging a bottle cap, and a portion for engaging a can tab formed therein. The maraca 10 includes a shell 12 enclosing pellets 14. The shell 12 may be formed of any suitable material such that impact of the pellets 14 on the shell generates a sound such as a rattle-type sound. Thus, for example, the shell may be formed of plastic The shape of the shell 12 may vary. For example, in the exemplary embodiments of FIGS. 1-10, the shell is shown as substantially round. In the exemplary embodiments of FIGS. 11-18, the shell is shown as substantially ovoid.

The handle 16 has a first end and a second end, generally cylindrical, and has a tapered shape including a wide portion, at the first end, for gripping by the hand of a user. A tool for engaging a bottle cap can be provided proximate the first end of the handle. A portion for engaging a can tab is provided proximate the second end of the handle.

In the exemplary embodiment shown in FIG. 1, the wide portion of cylindrical handle 16 is provided with a transverse groove 18 formed therein. The groove 18 includes a bottom grooved surface 24, a first side surface 26 and a second side surface 22. A metal tool 20 is mounted within groove 18, and arranged to engage the edge of a bottle cap for opening a bottle.

The second side surface 22 of the groove 18 forms an interior angle from the bottom surface 24. The exact degree of the interior angle between the second side surface 22 and the bottom surface 24 may vary. One suitable degree is approximately 145 degrees. The first side surface 26 also forms an interior angle with the bottom surface 24. Generally, the angle formed by the first side surface 26 and the bottom surface 24 is greater than 90 degrees. One suitable angle is approximately 115 degrees.

The second end of the handle 16 includes an extending portion forming a pressure tab 17. The pressure tab 17 may extends either generally parallel to the surface of the shell 12, and possibly extending away therefrom. The pressure tab 17 may be formed integrally with the handle 16 or may be a separate component coupled to the handle 16 and/or the shell 12. The end of the pressure tab 17 provided distal from the handle 16 may be used to couple with an opener of a can, and lift the opener so as to open the can, i.e., thus functioning as a can opener. Thus, the tab 17 can pick up a tab of the can, and assist in the motion of the opener away from the top plane of the can, thereby facilitating the opener to open the can. Thus, a space may be maintained between the pressure tab 17 and the shell 12, at least for a portion of the shell 12. In addition to functioning as a can opener, the pressure tab reduces or prevents a transfer of pressure from the handle 16 to the shell 12. Thus, when pressure is applied to the handle 16 to open a can (or a bottle), that pressure is preferably not transferred to the shell 12. If a substantial amount of pressure was to be transferred to the shell 12, there may be a risk that the shell 12 may break from the handle 16, and/or the tab 17 may break from the handle 16 or the shell 12.

Figure 2:
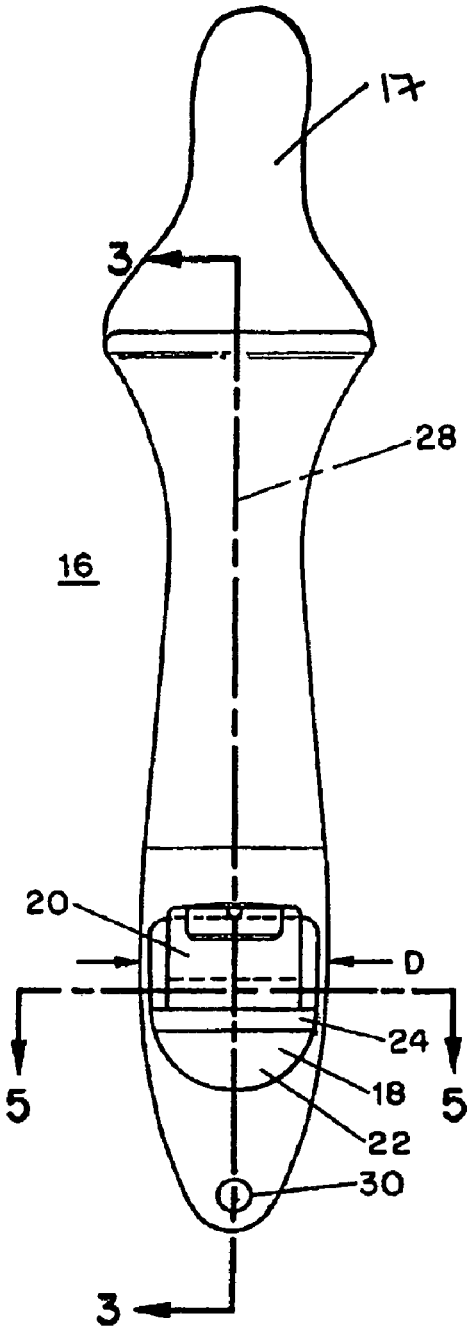
FIG. 2 is a front view of a handle of the maraca shown in FIG. 1.

FIG. 2 is a front view of the handle 16 of the maraca 10 of FIG. 1. The handle 16 includes a central axis 28. The bottom surface 24 of the groove 18 may be substantially planar and parallel to the central axis 28. The enlarged portion of the cylindrical handle 16 has a diameter D which may be, for example, approximately 15 millimeters. A bore 30 can be provided at the end of handle 16, and may be used to attach the maraca 10 as an ornament to a key chain.

Figure 3:
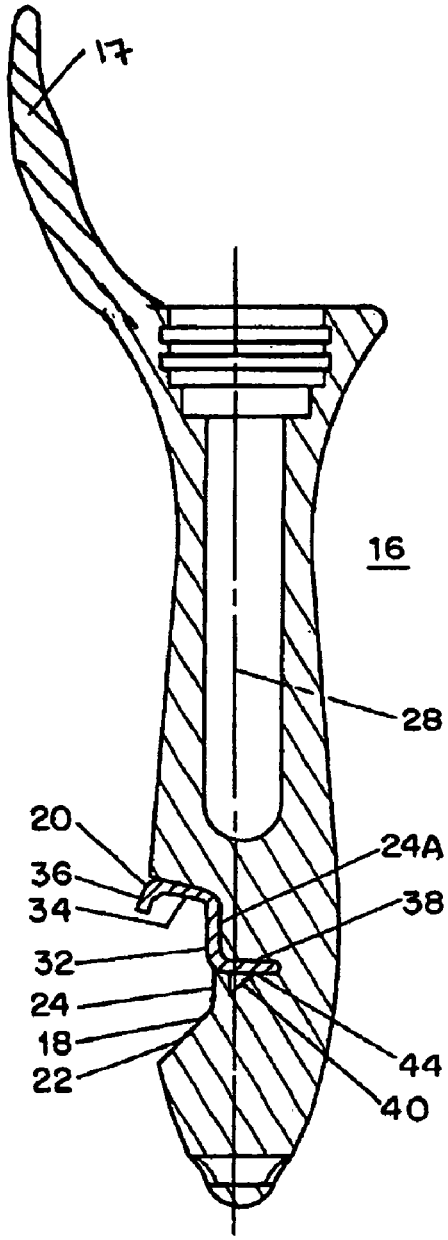
FIG. 3 is a cross sectional left side view of the handle of the maraca shown in FIG. 1.

FIG. 3 provides a cross-sectional view of the cylindrical handle along the line 3-3 of FIG. 2. In FIG. 3, the metal tool 20 is mounted within the groove 18 of the cylindrical handle 16. The metal tool 20 is described in greater detail below with reference to FIG. 4. The metal tool 20 includes a first web portion 32, a second web portion 34, a third web portion 36, and a fourth web portion 38. The fourth web portion 38 of the metal tool 20 is driven into a slot 44 formed in the cylindrical handle 16. The slot 44 is substantially perpendicular to the central axis 28. The fourth web portion 38 of the metal tool 20 is inserted into the slot 44 until the first web portion 32 comes in contact with an undercut 24A of the surface 24. The undercut 24A is formed in surface 24 to accommodate the cooperation with the metal tool 20. A portion 40 of the fourth web portion 38 may be pressed out to form a tooth for engaging the interior of slot 44, and to retain the metal tool 20 therein.

Figure 4:
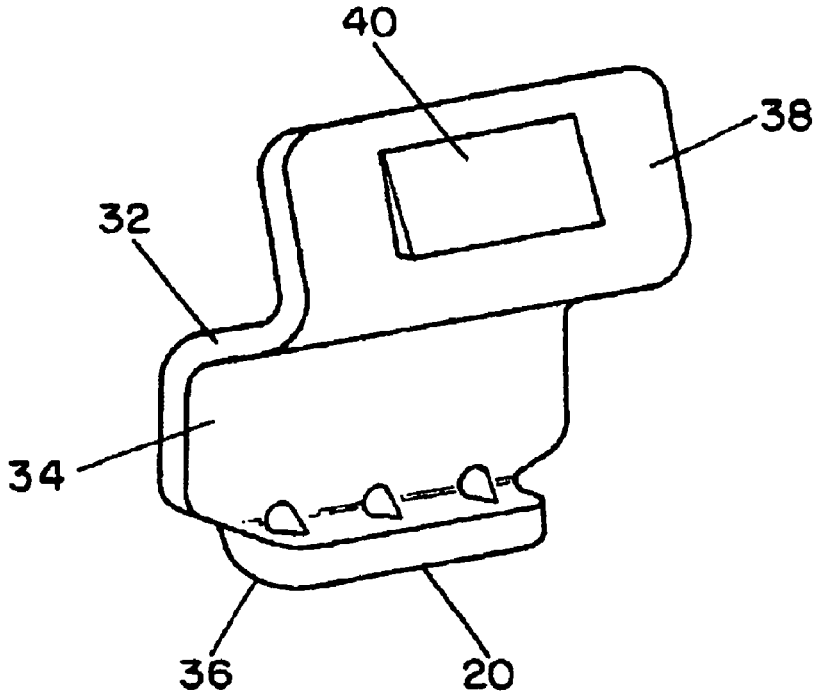
FIG. 4 is a first exemplary embodiment of a metal tool that can be used in connection with the maraca shown in FIG. 1.

FIG. 4 provides a perspective view of the metal tool 20. The metal tool 20 is made of a metallic web, preferably steel, such as stainless steel or harden steel plated with chromium. The first web portion 32 lies against surface 24, preferably in an undercut 24A in surface 24. The second web portion 34 lies against the first side surface 26 of groove 18. The third web portion 36 extends outwardly from web portion 34 toward second side surface 22 as shown in FIG. 3. The third web portion 36 is configured to engage with an underside of the bottle cap. The fourth web portion 38 extends from the first web portion 32 at the opposite end thereof, and is configured to be received in the slot 44 formed in the handle 16.

Figure 5:
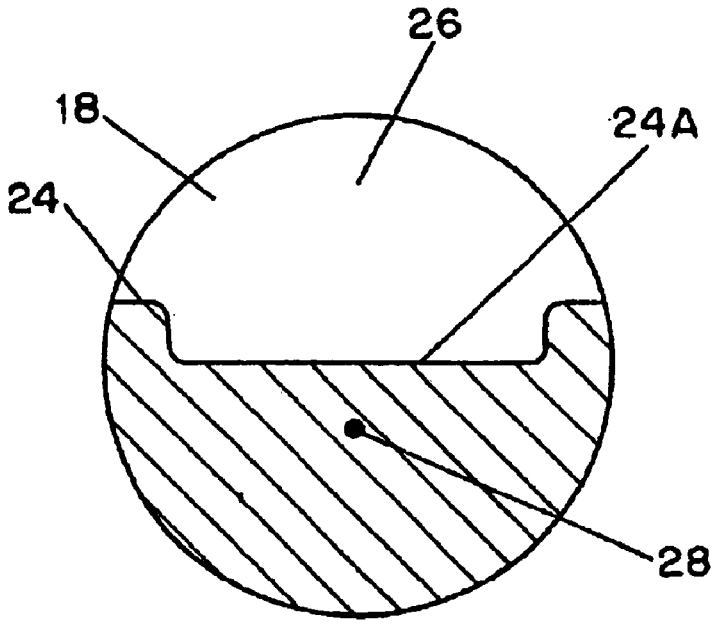
FIG. 5 is a cross sectional exploded side view of the handle of FIG. 1.

FIG. 5 provides a cross-sectional view of the cylindrical handle along the line 5-5 of FIG. 2. In FIG. 5 the metal tool 20 is not yet mounted within the groove 18 of the cylindrical handle 16 for the purpose of describing this section in further detail. The undercut 24A is formed in the surface 24 to accommodate the metal tool 20. The undercut 24A is preferably substantially planar and preferably parallel to the central axis 28. The undercut 24A is closer to the axis 28 of the cylindrical handle 16 than the surface 24. The first side surface 26 of the groove 18 is in contact with one end of the surface 24.

Figure 6:
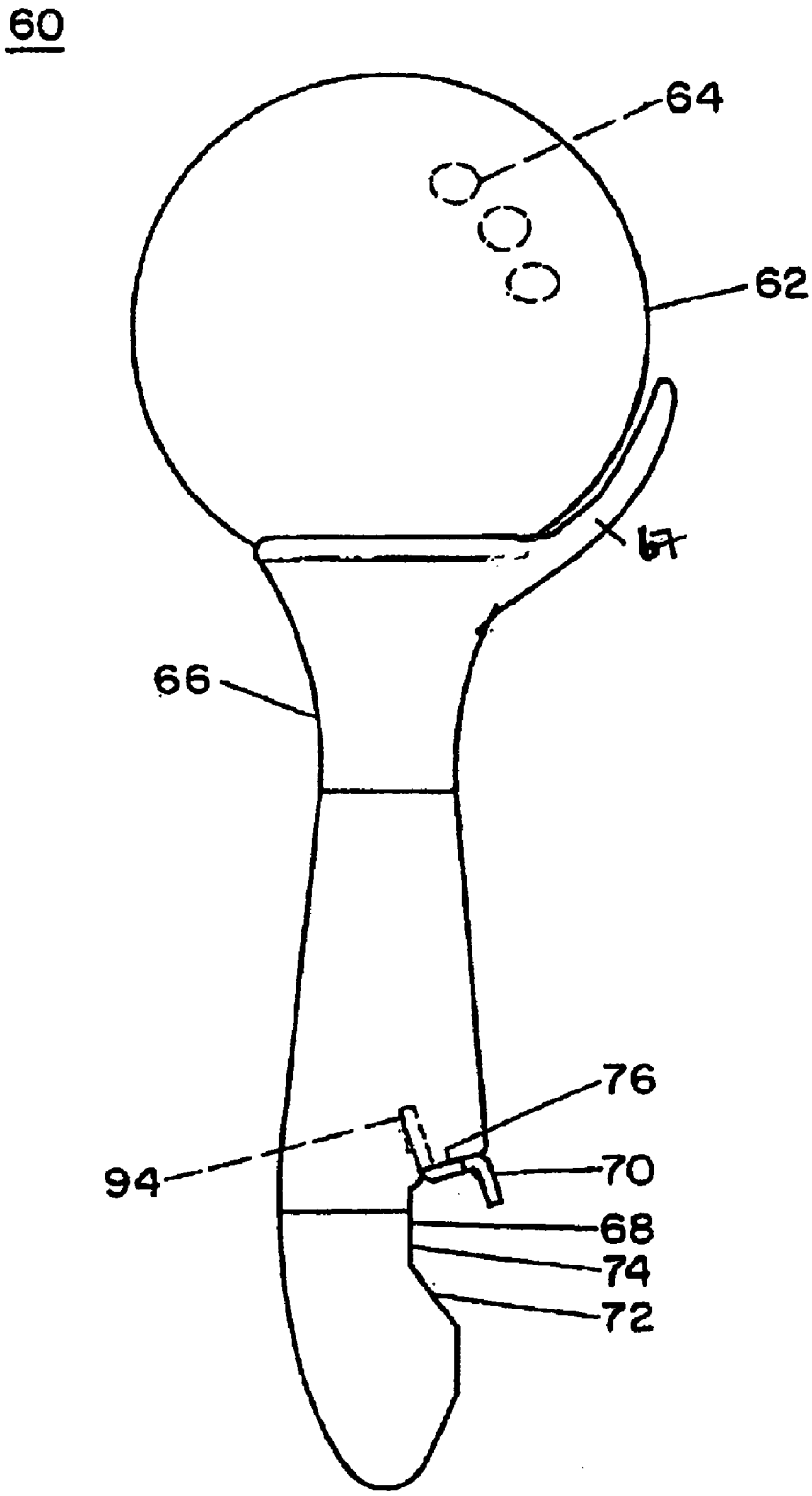
FIG. 6 is a side view of the handle of the maraca shown in FIG. 1.

FIG. 6 show a right side view of a second exemplary embodiment of a maraca 60 according to the present invention. The maraca 60 includes a shell 62 enclosing pellets 64 for providing a rattle type sound. The maraca 60 includes a handle 66 having a first end and a second end. The handle 66 is generally cylindrical and has a tapered shape including a wide portion at the first end of the handle for gripping by the hand of a user. The wide portion of cylindrical handle 66 is provided with a transverse groove 68 formed therein. The groove 68 includes a bottom grooved surface 74, a first side surface 76 and a second side surface 72. A metal tool 70 is mounted within groove 68, and arranged to engage the edge of a bottle cap for opening a bottle.

The second side surface 72 forms an interior angle from the bottom surface 74. The interior angle of the second side surface 72 with the bottom surface may be approximately 145 degrees. The first side surface 76 forms an interior angle with the bottom surface 74. The interior angle of the first side surface 76 with the bottom surface 74 is generally greater than 90 degrees and may be, for example, approximately 115 degrees.

The second end of the handle 66 includes an extending portion forming a pressure tab 67, which can be structured and may operate in an approximately the same manner as the pressure tab 17 of FIG. 1. Thus, the pressure tab 67 is able to couple with the opener of the can (e.g., aluminum can) to open the can.

Figure 7:
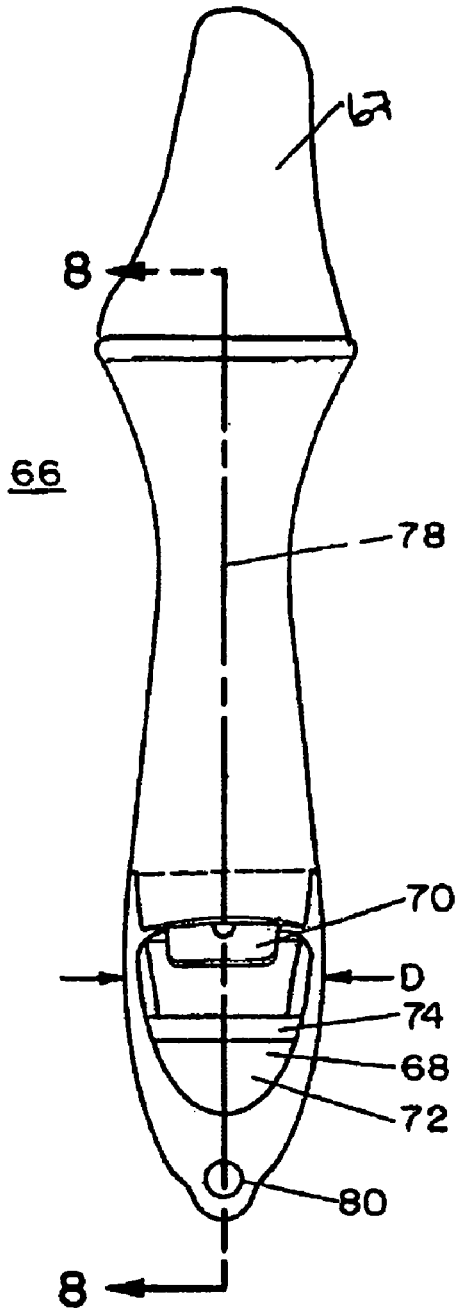
FIG. 7 is a front view of the handle of the maraca shown in FIG. 6.

FIG. 7 is a front view of the cylindrical handle 66 of the maraca 60 of FIG. 6. The cylindrical handle 66 includes a central axis 78. The bottom surface 74 of groove 68 is preferably substantially planar, and preferably parallel to the central axis 78. The enlarged portion of the cylindrical handle 66 has a diameter D which is approximately 15 millimeters. A bore 80 is provided at the end of the handle 66, and may be used to attach the maraca 60 as an ornament to a key chain.

Figure 8:
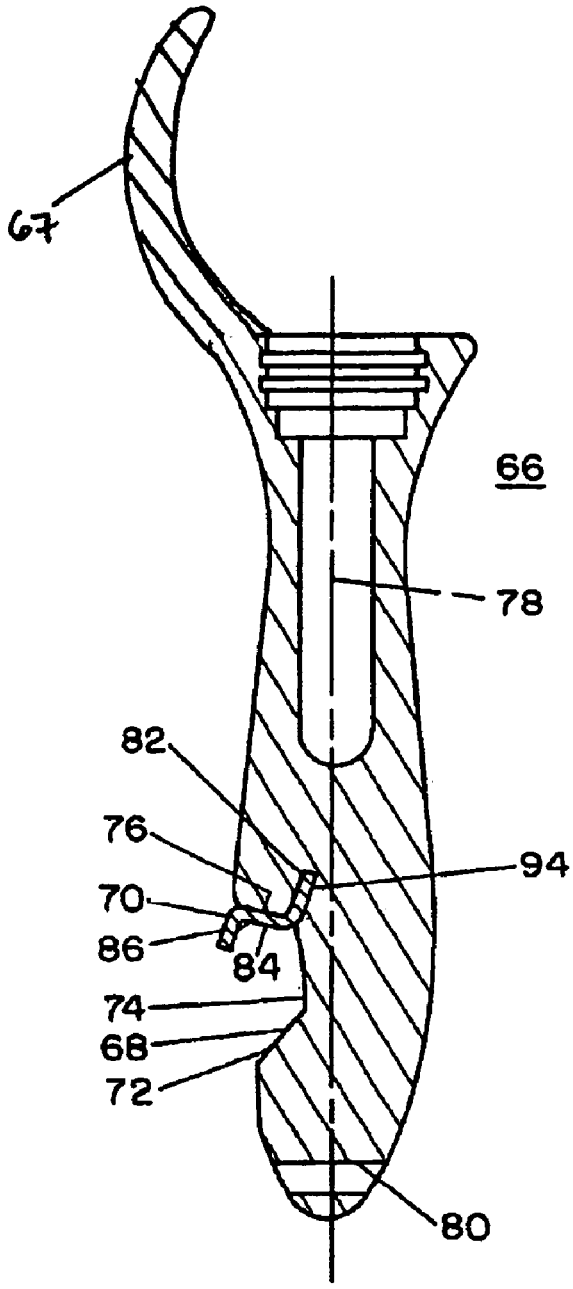
FIG. 8 is a cross-sectional left side view of the handle of the maraca shown in FIG. 6.

FIG. 8 provides a cross-sectional view of the cylindrical handle along the line 8-8 of FIG. 7. In particular, FIG. 8 shows that the metal tool 70 is mounted within the groove 68 of the cylindrical handle 66. The metal tool 70 is described in greater detail below with reference to FIGS. 9 and 10. The metal tool 70 includes a first web portion 84, a second web portion 86, and a third web portion 82. The third web portion 82 of the metal tool 70 is driven into a slot 94 formed in the cylindrical handle 66. The slot 94 may extend at a slight angle from or can be substantially parallel to the central axis 78. The slot 94 can extend from the juncture of the bottom grooved surface 74 and the first side surface 76 towards the shell 62 and a center of the handle 66. The third web portion 82 of the metal tool 70 can be inserted into the slot 94 until the first web portion 84 comes in contact with the first side surface 76. Two portions 90, 92 of the third web portion 82 (shown in FIG. 9) are pressed out to form a teeth for engaging the interior of slot 94, and to retain the metal tool 70 therein.

Figure 9:
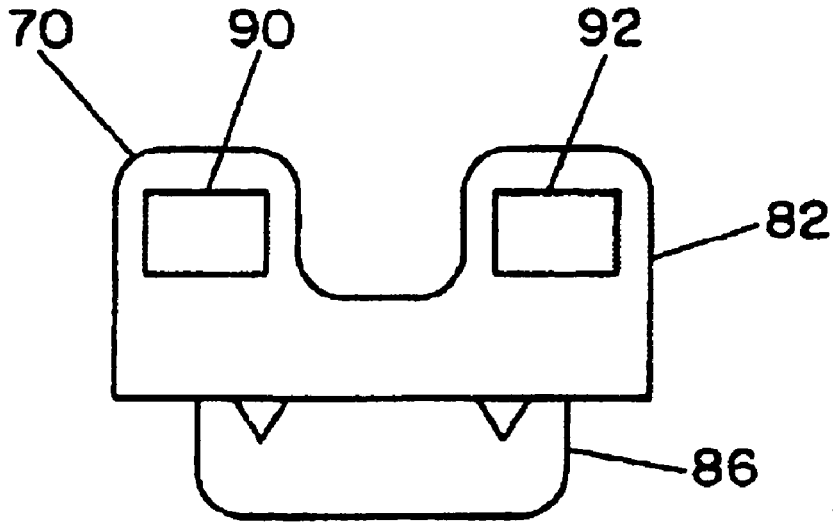
FIG. 9 is a front view of a second exemplary embodiment of the metal tool used in connection with the maraca shown in FIG. 6.

The details of the metal tool 70 are provided in FIG. 9 which shows a front view thereof. The metal tool 70 is made of a metallic web, preferably steel, such as stainless steel or harden steel plated with chromium. The third web portion 82 of the metal tool 70 extends from the first web portion 84, and is arranged to be received in the slot 94 formed in the handle 66. Two portions 90, 92 of the third web portion 82 are pressed out to form teeth for engaging the interior of the slot 94, and retaining the metal tool 70 therein.

Figure 10:
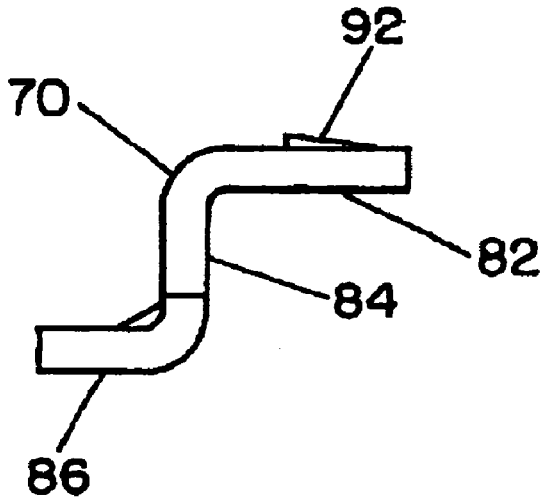
FIG. 10 is a side view of the metal tool shown in FIG. 9.

FIG. 10 provides a side view of the metal tool 70, in which the first web portion 84 lies against the first side surface 76. The second web portion 86 extends outwardly from the first web portion 84 at the opposite end thereof, from the third web portion 82, as is illustrated in FIG. 8. The second web portion 86 is configured with an underside of the bottle cap.

Figure 11:
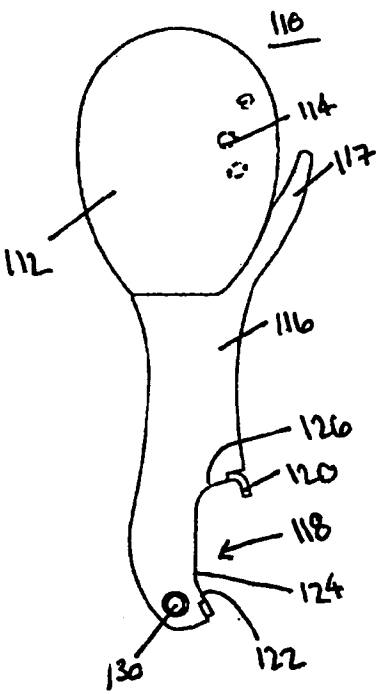
FIG. 11 is a right side view of a third exemplary embodiment of a maraca in accordance with the present invention.

FIG. 11 is a right side view of a third exemplary embodiment of the maraca 110 according to the present invention. The maraca 110 includes a shell 112 enclosing pellets 114. The shell may be formed of any suitable material such that impact of the pellets on the shell generates a sound such as a rattle-type sound. Thus, for example, the shell may be formed of plastic In the embodiment shown, the shell 112 is substantially ovoid.

The maraca 110 includes a handle 116 having a first end and a second end. The handle 116 is generally cylindrical and has a tapered shape including a wide portion, at the first end, for gripping by the hand of a user. The wide portion of cylindrical handle 116 is provided with a transverse groove 118 formed therein. The groove 118 includes a bottom grooved surface 124, a first side surface 126 and a second side surface 122. A metal tool 120 is mounted within groove 118, and arranged to engage the edge of a bottle cap for opening a bottle. The metal tool 120 may be mounted within the groove 118 in any suitable manner. For example, the metal tool 120 may be screwed into the groove 118.

The second side surface 122 of the groove 118 forms an interior angle from the bottom surface 124. The exact degree of the interior angle between the second side surface 122 and the bottom surface 124 may vary. One suitable degree is approximately 145 degrees. The first side surface 126 also forms an interior angle with the bottom surface 124. Generally, the angle formed by the first side surface 126 and the bottom surface 124 is greater than 90 degrees. One suitable angle is approximately 115 degrees.

The second end of the handle 116 includes an extending portion forming a pressure tab 117. The pressure tab 117 extends generally parallel with the surface of the shell 112. The pressure tab 117 may be formed integrally with the handle 116 or may be a separate component coupled to the handle 116. The end of the pressure tab 117 away from the handle 116 may function as a can opener. Thus, a space is maintained between the pressure tab 117 and the shell 112. In addition to functioning as a can opener, the pressure tab prevents transfer or pressure from the handle 116 to the shell 112. Thus, when pressure is applied to handle 116 to open a bottle or a can, that pressure is not transferred to the shell 112. When pressure is transferred to the shell 112, there is a risk that the shell 112 may break from the handle 16.

Figure 12:
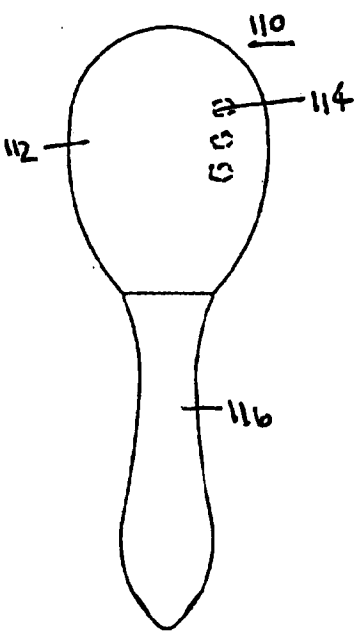
FIG. 12 is a rear side view of the maraca shown in FIG. 11.
Figure 13:
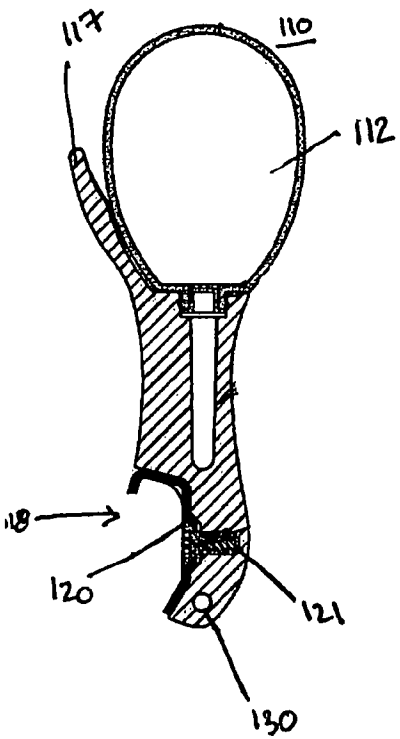
FIG. 13 is a cross sectional left side view of the maraca shown in FIG. 11.

FIG. 12 shows a rear view and FIG. 13 provides a cross-sectional view of the maraca 110 of FIG. 11. As shown in FIG. 13, the metal tool 120 is mounted within the groove 118 of the cylindrical handle 116 via a screw 121. The screw 121 is threaded substantially perpendicular to a central axis of the handle. A bore 130 can be provided at the end of handle 116, and may be used to attach the maraca 110 as an ornament to a key chain. As shown in FIG. 13, the shell 112 may be connected to the handle 116 via a plastic or metal extension. This extension may be connected to one end of the shell 112, and can inserted into to a mating bore of the handle 112. In this manner, the connection between the shell 112 and the handle 116 can be reinforced to further facilitate the pressure tab 117 to be able to move the opener of the can, without possibly causing the shell 112 from being separated from the handle 116.

Figure 14:
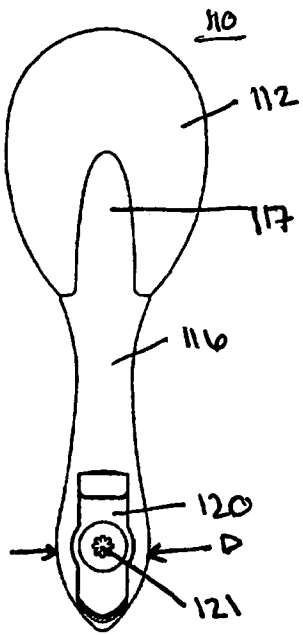
FIG. 14 is a front side view of the maraca shown in FIG. 11.

FIG. 14 is a front view of the maraca 110 of FIG. 11. The maraca handle 116. The enlarged portion of the cylindrical handle 116 has a diameter D which may be, for example, approximately 15 millimeters. In addition, the pressure tab 117 is shown as having an oval shape in the are which is intended to be coupled to the opener of the can.

Figure 15:
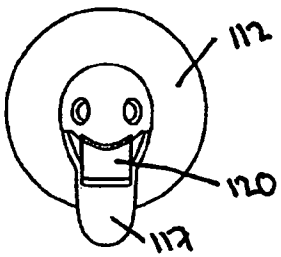
FIG. 15 is a top view of the maraca shown in FIG. 11.
Figure 16:
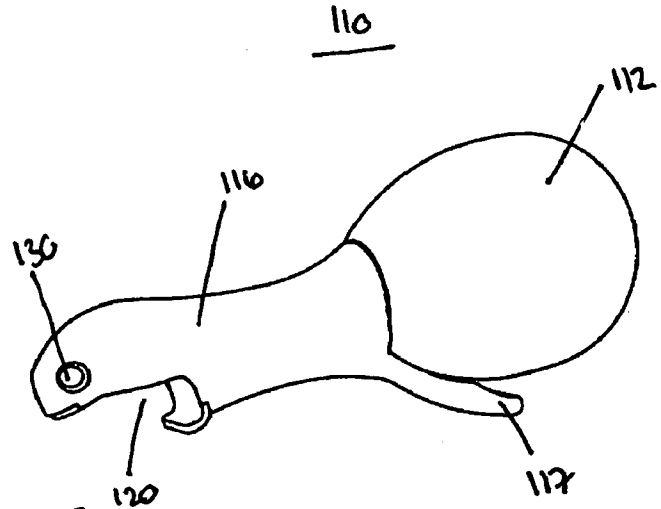
FIG. 16 is a first perspective view of the maraca shown in FIG. 11.
Figure 17:
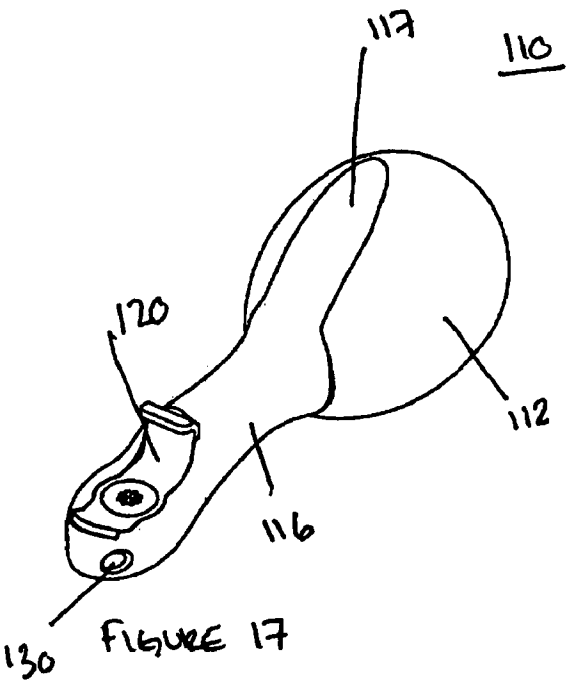
FIG. 17 is a second perspective view of the maraca shown in FIG. 11.
Figure 18:
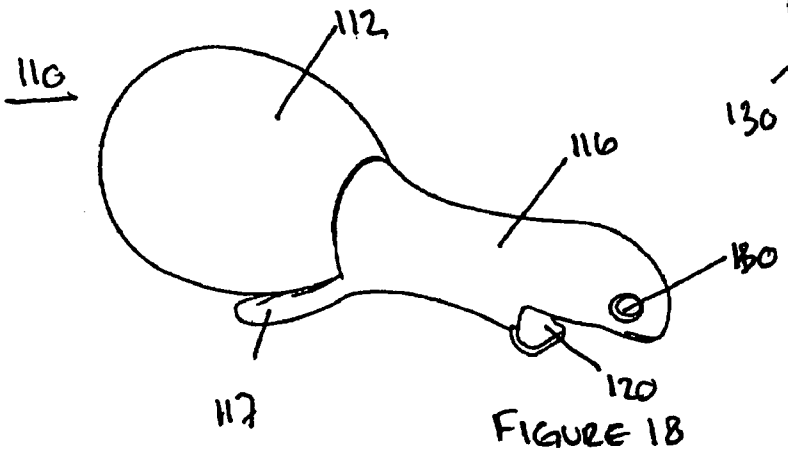
FIG. 18 is a third perspective view of the maraca shown in FIG. 11.

FIG. 15 is a bottom view of the maraca 110 of FIG. 11. As shown, the pressure tab 117 extends 120 somewhat from the shell 112 of the maraca 110. FIGS. 16, 17 and 18 illustrate various perspective views of the maraca 110 of FIG. 11.

The foregoing merely illustrates the principles of the invention. Various modifications and alterations to the described embodiments will be apparent to those skilled in the art in view of the teachings herein. It will thus be appreciated that those skilled in the art will be able to devise numerous arrangements which, although not explicitly described herein, embody the principles of the invention and are thus within the spirit and scope of the invention.

What is claimed is:

1. A bottle and can opener, comprising:

a maraca shell:

an elongated member having an end and an outer surface which forms a handle, the handle including:

a tool configured to engage a bottle cap, and a part provided at said end of the elongated member that is configured to engage an opener or a tab of a can, wherein the member is configured to couple to said maraca shell, wherein the part has a first end which is provided at or near said maraca shell, and a second end which is provided at a distance from said maraca shell, and wherein said part for at least a portion thereof, extends approximately along and spaced from at least a portion of the shell.

2. The bottle and can opener of claim 1, wherein the part is integral with the handle.

3. The bottle and can opener of claim 1, wherein the part is coupled to the handle.

4. The bottle and can opener of claim 3, wherein the handle further comprises a groove extending transversely across the handle, the groove having a first side surface, a second side surface, a bottom surface, and a slot and wherein the tool includes a first portion extending along the first side surface of the groove and a second portion extending outward from the first side surface of the groove.

5. The bottle and can opener of claim 4, wherein the groove is sized such that the distance between the first side surface and the second side surface of the groove corresponds to an approximate radius of the bottle cap.

* * * * *